US007207816B1

(12) United States Patent
Friske

(10) Patent No.: US 7,207,816 B1
(45) Date of Patent: Apr. 24, 2007

(54) GAS TIGHT ELECTRICAL CONNECTIONS WITH SHAPE MEMORY RETAINERS

(75) Inventor: Gordon W. Friske, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 11/283,106

(22) Filed: Nov. 18, 2005

(51) Int. Cl.
*H01R 13/20* (2006.01)

(52) U.S. Cl. ..... 439/161

(58) Field of Classification Search ..... 439/161, 439/790

See application file for complete search history.

(56) References Cited

U.S. PATENT DOCUMENTS 3,740,839 A * 6/1973 Otte et al. ..... 29/830
4,022,519 A 5/1977 Hill

* cited by examiner

*Primary Examiner*—Neil Abrams
(74) *Attorney, Agent, or Firm*—Stephen G. Mican

(57) ABSTRACT

A gas-tight electrical connection comprises a conductive substrate with at least one socket for receiving an associated wire, at least one slot in the conductive substrate that penetrates each socket and at least one SMA force ring that slides over the conductive substrate near each slot to clamp the electrical connection when heated to its austenitic state.

6 Claims, 3 Drawing Sheets

GAS TIGHT ELECTRICAL CONNECTIONS WITH SHAPE MEMORY RETAINERS

FIELD OF THE INVENTION

The invention relates to electrical wiring for adverse environmental conditions, and more particularly to wiring connections and connectors for electrical equipment and machinery subject to high temperatures and corrosive conditions.

BACKGROUND OF THE INVENTION

It is difficult to fabricate mechanically strong and reliable small size copper electrical connections for use in oil or air cooled electrical components that are subject to high temperatures and corrosive conditions, such as rotating and stationary generator and motor components for aeronautical applications. These connections are subject to failure for reasons connected to their methods of fabrication.

For instance, in the case of a connection of a wire to an electrical connector or buss bar, a connection that comprises soldering or brazing, the heat generated by the soldering or brazing process may degrade or embrittle the wire. A connection that comprises crimping eventually degrades through the thermal cycling of the wire that loosens the seal of the crimp.

There have been some attempts to use a shape memory alloy (SMA) for fabricating electrical connectors. For instance, U.S. Pat. No. 4,022,519 to Hill describes electrical connections that comprise a resilient, non-deformable member, such as a connector pin, that deforms a non-resilient, deformable conductive member with at least a hollowed out and slotted end to accept it and a SMA force ring that surrounds the deformable conductive member proximate the inserted non-deformable member. In other words, the non-deformable member stretches and enlarges the diameter of the deformable member and the concentric SMA force ring as it penetrates the hollowed out tined end of the deformable member.

Application of sufficient heat to the SMA force ring causes the SMA force ring to shrink to its original size. Since the SMA force ring mounts concentrically on the deformable member, it deforms the deformable member around the inserted portion of the non-deformable member.

The fabricated connection of this type overcomes the disadvantages of the soldered and crimped connections described above. However, this type of connection is not suitable for all applications for several reasons. First, it requires a non-resilient, deformable member that resembles a tube to accept the non-deformable member and the SMA force ring. It is not usable if the connection requires all resilient, non-deformable materials. Second, the fabrication of this type of connection requires that the non-deforming member have sufficient strength so that it expands both the deformable member and the SMA force ring that mounts concentrically over it, or the addition of a step of expanding the deformable member and SMA force ring with a suitable mandrel. Third, the types of connections addressed by this process are only of the axial or end type, wherein the non-deformable and deformable members join in-line axially. These types of connections are not suitable for side or radial connections of wires to conductive substrates, such as buss bars, for instance.

SUMMARY OF THE INVENTION

The present invention overcomes the limitation of the prior art electrical connections described above with electrical connections that comprise a conductive substrate with at least one socket for receiving a connection wire that has a slot that propagates through the socket perpendicular to its linear axis and a SMA force ring that is deformed in its martensitic state to fit over a portion of the slotted substrate. Application of heat to the SMA force ring that is sufficient to change the ring to its austenitic state shrinks the ring to its original size, thereby compressing the slotted substrate and clamping the connection wire in the socket.

Generally, the invention comprises a gas-tight electrical connection for at least one wire to a conductive electrical substrate, comprising: a socket for each wire that penetrates the substrate with a diameter and depth large enough to insert the wire into the substrate with sufficient contact area for a desired electrical connection between the wire and the substrate; at least one slot that penetrates the substrate and each socket arranged so that the plane of the slot propagates along the axis of each socket; and at least one shape memory alloy (SMA) force ring that has a deformed martensite diameter that is enlargened to slip over the substrate near each slot in the substrate; wherein heat applied to change each SMA force ring to its austenitic state causes each SMA force ring to contract to its original diameter and compress each wire in each socket, thereby establishing a gas-tight connection.

DESCRIPTION OF THE DRAWINGS

FIG. 2 is an end view of the first possible embodiment of the invention shown in FIG. 1.

DETAILED DESCRIPTION OF THE INVENTION

Figure 1:
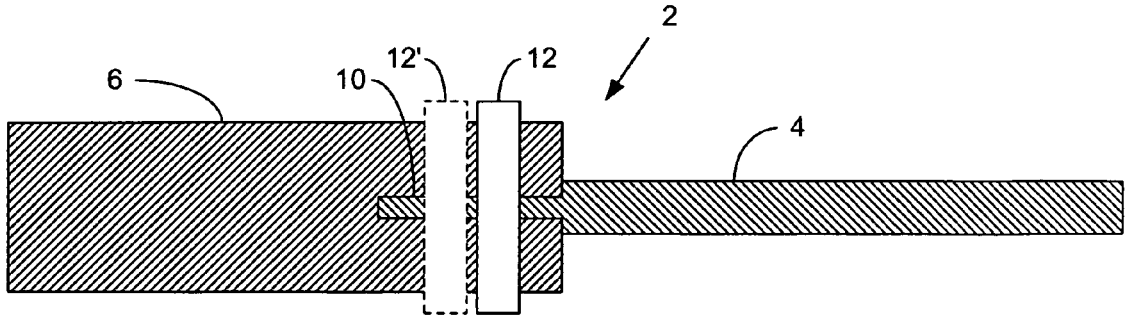
FIG. 1 is a side view of a first possible embodiment of the invention for an end or axial type electrical connection between a wire and a conductive substrate.
Figure 2:
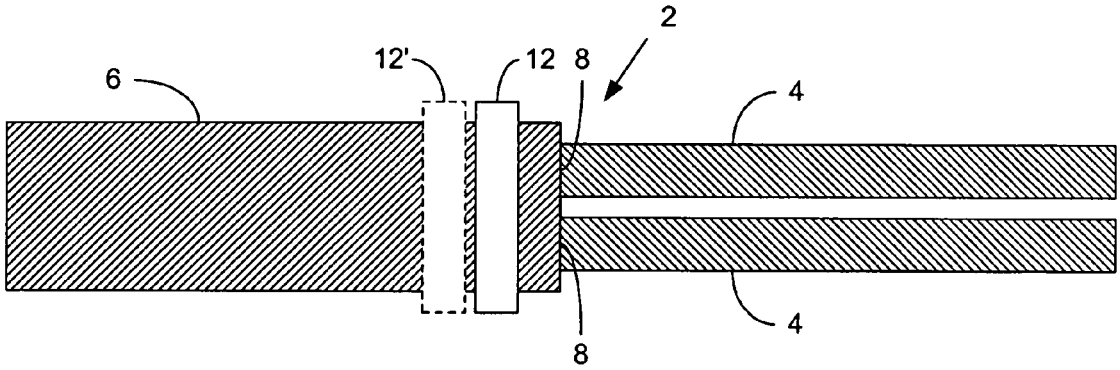
FIG. 2 is a top view of the first possible embodiment of the invention shown in FIG. 1.
Figure 3:
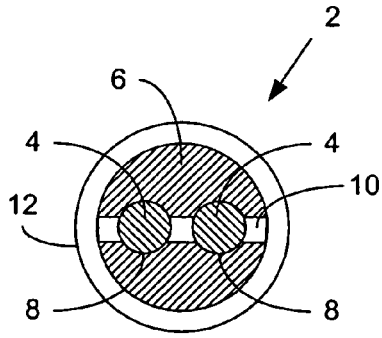

FIGS. 1, 2 and 3 are side, top and end views, respectively, of a first possible embodiment of the invention for an end or axial type of electrical connection 2 between at least one wire 4 and a conductive substrate 6. Although FIGS. 1 through 3 show two wires 4 are shown in for purposes of illustration, this embodiment may employ a single wire 4 or more than two wires 4.

Upon assembly, each wire 4 slides into a respective aperture or socket 8 that penetrates one end of the substrate 6 axially or endways. Each socket 8 is approximately the same diameter as the wire 4. The depth of each socket 8 in the substrate 6 is sufficient to let its respective wire 4 penetrate the substrate 6 a desired amount to achieve a desired contact area with the substrate 6.

At least one slot 10 axially or endways propagates through the substrate 6 to penetrate each socket 8 for at least the depth of each socket 8 as best shown in FIG. 1. Each slot 10 also propagates through the substrate 6 radially or sideways to penetrate each socket 8. Although FIG. 1 shows a single slot 10 that propagates through both of the two sockets 8 in FIGS. 1 and 3, alternatively two slots 10 at approximate right angles to the single slot 10 shown in FIG. 3 are suitable, with each slot 10 penetrating a different socket 8.

At least one SMA force ring 12 slides over the region of the substrate 6 that the wires 4 penetrate the sockets 8. Each SMA force ring 12 preferably comprises nickel titanium, although any SMA can be used, such as such as copper-aluminium-nickel, copper-zinc-aluminium and iron-manganese-silicon. Generally, a single SMA 12 ring is preferable, as shown, but alternatively, multiple SMA force rings 12 may be stacked together, such as a represented by second SMA force ring 12' shown in dashed line.

Each SMA force ring 12 has an original aperture size that is slightly smaller in diameter than the substrate 6. Deforming each SMA force ring 12 in its martensite state by enlarging its aperture to slightly greater than the circumference of the substrate 6 allows it to easily slide over the substrate 6. When each SMA force ring 12 is correctly positioned over the substrate 6, the application of heat that is sufficient to start to change each SMA force ring 12 to its austenitic state causes each SMA force ring to start to return to its original dimension, thereby causing each SMA force ring 12 to reduce its enlargened aperture and radially compress the substrate 6. Due to the slot 10 that passes through each socket 8, the radial compression of the substrate 6 causes each socket 8 to clamp onto its respective wire 4. This establishes a secure, gas-tight connection between each wire 4 and the substrate 6 that is not degraded by the fastening process and is not subject to loosening due to thermal cycling of the electrical connection 2.

Figure 4:
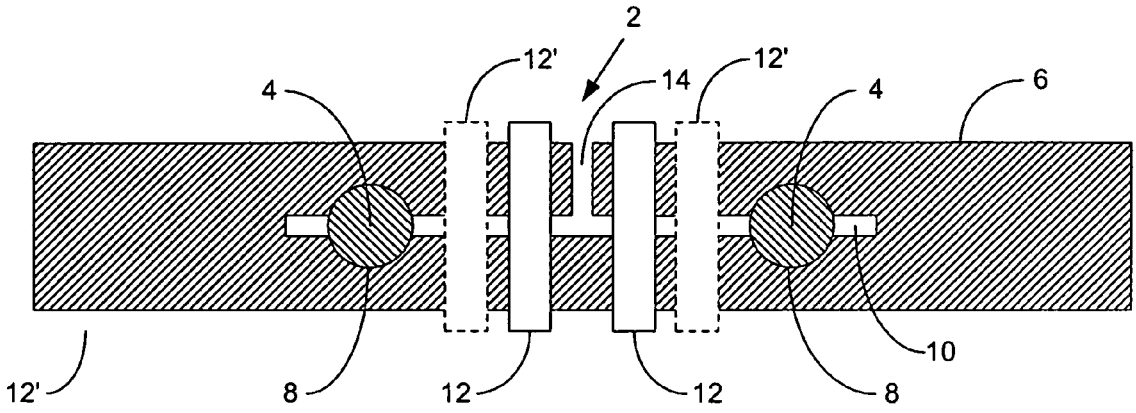
FIG. 4 is a side view of a second possible embodiment of the invention for a side or radial type electrical connection between two wires and a conductive substrate.
Figure 5:
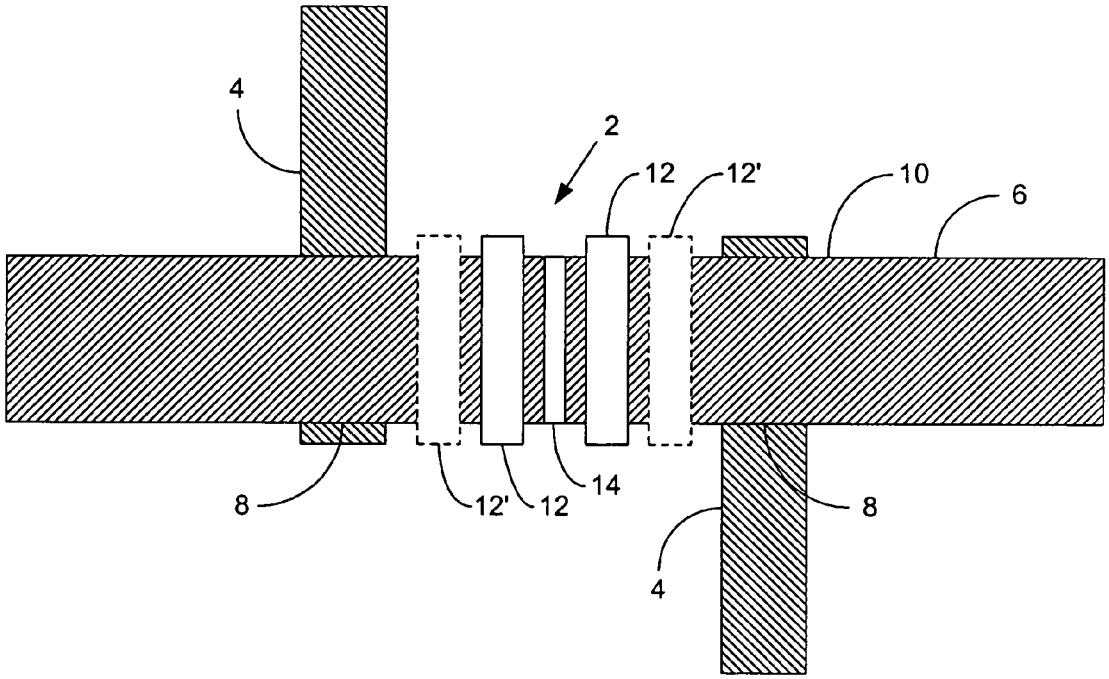
FIG. 5 is a top view of the second possible embodiment of the invention shown in FIG. 4.

FIGS. 4 and 5 are side and top views, respectively, of a second possible embodiment of the invention for a side or radial type of electrical connection 2 between at least one wire 4 and a conductive substrate 6. Although FIGS. 4 and 5 show two wires 4 for purposes of illustration, this embodiment may employ a single wire 4 or more than two wires 4.

Upon assembly, each wire 4 slides into a respective aperture or socket 8 that penetrates the substrate 6 radially or sideways. Each socket 8 is approximately the same diameter as the wire 4. The depth of each socket 8 is generally the width of the substrate 6, but in any case it is sufficient to let its respective wire 4 penetrate the substrate 6 a desired amount to achieve a desired contact area with the substrate 6.

At least one slot 10 radially or sideways propagates through the substrate 6 to penetrate through each socket 8. The slot 10 may extend axially or endways through the substrate to penetrate each socket 8, and even beyond each socket 8, as best shown in FIG. 4.

At least one SMA force ring 12 slides over the region of the substrate 6 that the wires 4 penetrate the sockets 8. Each SMA force ring 12 preferably comprises nickel titanium, although any SMA can be used, such as such as copper-aluminium-nickel, copper-zinc-aluminium and iron-manganese-silicon. Generally, a single SMA 12 ring is preferable, as shown, but alternatively, multiple SMA force rings 12 may be stacked together, such as a represented by second SMA force ring 12' shown in dashed line.

Each SMA force ring 12 has an original aperture size that is slightly smaller in diameter than the substrate 6. Deforming each SMA force ring 12 in its martensite state by enlarging its aperture to slightly greater than the circumference of the substrate 6 allows it to easily slide over the substrate 6. When each SMA force ring 12 is correctly positioned over the substrate 6, the application of heat that is sufficient to start to change each SMA force ring 12 to its austenitic state causes each SMA force ring to start to return to its original dimension, thereby causing each SMA force ring 12 to reduce its enlargened aperture and radially compress the substrate 6. Due to the slot 10 that passes through each socket 8, the radial compression of the substrate 6 causes each socket 8 to clamp onto its respective wire 4. A notch 14 that cuts into the slot 10 assists compression of the substrate 6. This establishes a secure, gas-tight connection between each wire 4 and the substrate 6 that is not degraded by the fastening process and is not subject to loosening due to thermal cycling of the electrical connection 2.

Figure 6:
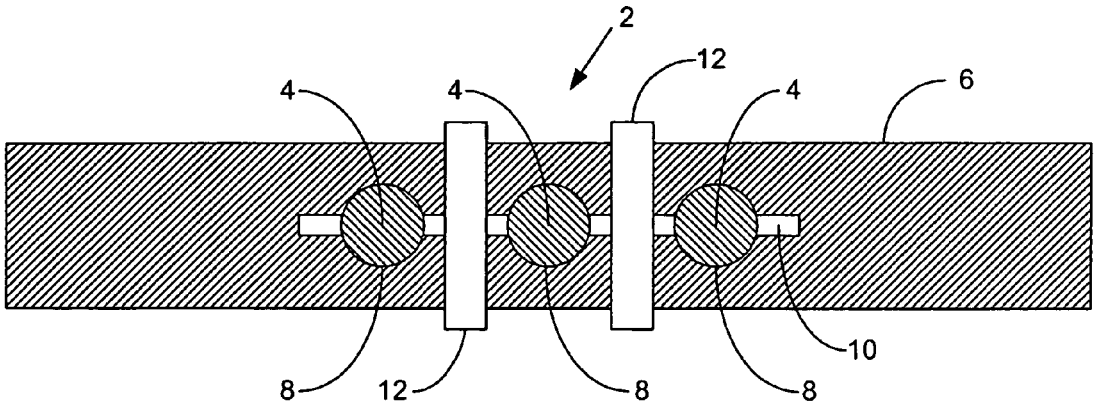
FIG. 6 is a side view of a third possible embodiment of the invention for a side or radial type electrical connection between two wires and a conductive substrate.
Figure 7:
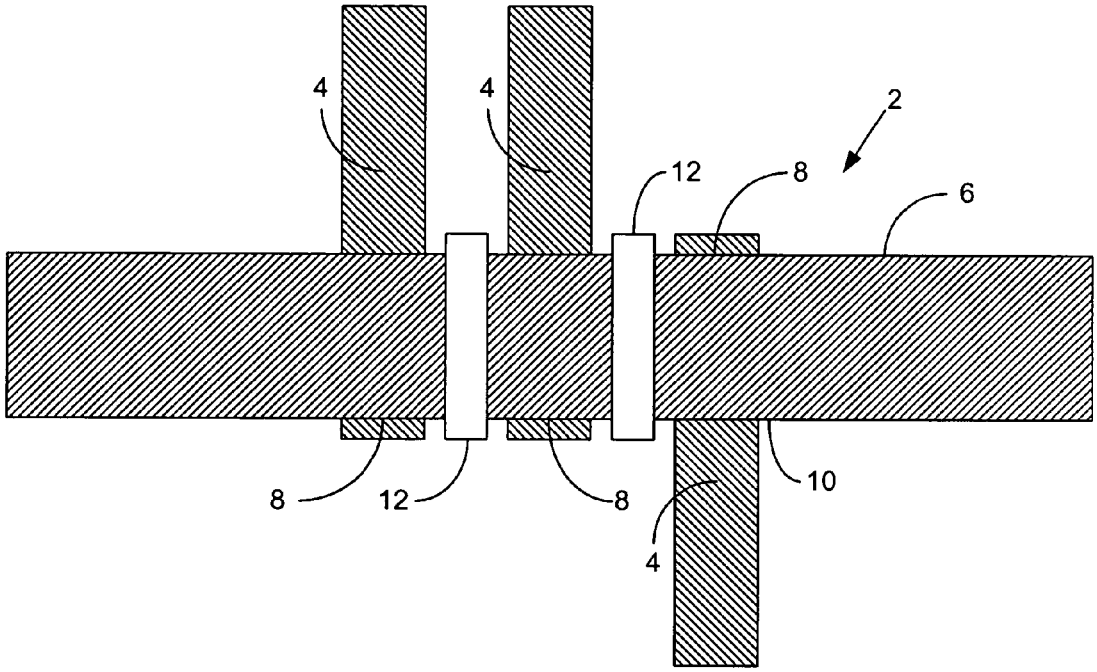
FIG. 7 is a top view of the third possible embodiment of the invention shown in FIG. 6.

FIGS. 6 and 7 are side and top views, respectively, of a third possible embodiment of the invention for a side or radial type of electrical connection 2 between at least one wire 4 and a conductive substrate 6. Although FIGS. 6 and 7 show three wires 4 for purposes of illustration, this embodiment may employ more or less than three wires 4. It is generally similar to the second embodiment described above in connection with FIGS. 4 and 5, except that the slot 10 extends continuously axially or endwise without the notch 14 so that the slot 10 may accommodate any number of wires 4. Of course, this embodiment requires somewhat larger SMA force rings 12 to achieve the same amount of clamping force on the wires 4.

One example of the axial or endways electrical connection 2 as shown in FIGS. 1 through 3 uses a conductive substrate 6 that comprises a 0.156 inch diameter copper or C15715 aluminium oxide dispersion copper rod and either a single 14 gauge or two 20 gauge wires 4. Using a single SMA force ring 12 comprising a nickel-titanium alloy having a 0.158 inch expanded aperture, 0.047 inch thickness and 0.047 inch length, heating the SMA force ring 12 to approximately 400 degrees F. shrunk the SMA force ring 12 to its austenitic state to load the substrate 6 with a compression force of approximately 310 pounds. Heating the SMA force ring 12 to a temperature of approximately 330 to 600 degrees F. should produce a similar result. The electrical connection 2 pulled apart in four different samples with loads of 41, 39, 46 and 31 pounds, respectively.

Another example of the radial or sideways electrical connection 2 as shown in FIGS. 4 and 5 uses the same 0.156 inch diameter copper or C15715 aluminium oxide dispersion copper rod for the conductive substrate 6 and the same nickel-titanium alloy SMA force rings 12, one for each wire 14, having a 0.158 inch expanded aperture, 0.047 inch thickness and 0.047 inch length as described above for the axial or endways electrical connection 2 example. The wires 4 are each 14 gauge. The slot 10 extends approximately 0.050 beyond each socket 8. After heating the SMA force rings 12 to their austenitic state as described above for the axial or endways electrical connection 2 example, the electrical connection 2 pulled apart in a load of approximately 10 pounds when the conductive substrate 6 comprised copper rod and approximately 28 pounds when the conductive substrate 6 comprised C15715 aluminium oxide dispersion copper rod.

The above-described examples used conveniently available sizes of SMA force rings 12 and do not represent or imply that their dimensions are best suited for use in the described embodiments. Of course, thicker and/or longer SMA force rings 12 shall achieve higher clamping forces to secure any desired connection strength. Likewise, thinner and/or shorter SMA force rings 12, or multiples thereof, shall also achieve other levels of clamping forces to secure any desired connection strength.

Described above is a gas-tight electrical connection that comprises a conductive substrate with at least one socket for receiving an associated wire, at least one slot in the conductive substrate that penetrates each socket and at least one SMA force ring that slides over the conductive substrate near each slot to clamp the electrical connection when heated to its austenitic state. The embodiments of the invention as described above are only some illustrative implementations of the invention wherein changes and substitutions of the various parts and arrangement thereof are within the scope of the invention as set forth in the attached claims.

What is claimed is:

1. A gas-tight electrical connection for at least one wire to a conductive electrical substrate, comprising:

a socket for each wire that radially penetrates the substrate with a diameter and depth large enough to insert the wire into the substrate with sufficient contact area for a desired radial electrical connection between the wire and the substrate;

at least one slot that radially penetrates the substrate and each socket arranged so that the plane of the slot propagates along the axis of each socket; and at least one shape memory alloy (SMA) force ring that has a deformed martensite diameter that is enlargened to slip over the substrate near each slot in the substrate;

wherein heat applied to change each SMA force ring to its austenitic state causes each SMA force ring to contract to its original diameter and compress each wire in each socket, thereby establishing a gas-tight connection.

2. The electrical connection of claim 1, wherein each SMA force ring is selected from the group of SMAs comprising nickel-titanium, copper-aluminium-nickel, copper-zinc-aluminium and iron-manganese-silicon.

3. The electrical connection of claim 2, wherein each SMA force ring comprises nickel-titanium.

4. The electrical connection of claim 1, wherein the conductive substrate is selected from the group of substrates comprising copper and aluminium oxide dispersion copper rod.

5. The electrical connection of claim 1, wherein heat applied to each SMA force ring is in the range of approximately 330 to 600 degrees F.

6. The electrical connection of claim 5, wherein heat applied to each SMA force ring is approximately 400 degrees F.

* * * * *